US008322458B2

(12) United States Patent
Stoetzer et al.

(10) Patent No.: US 8,322,458 B2
(45) Date of Patent: Dec. 4, 2012

(54) DRILLING RIG AND DRILLING METHOD

(75) Inventors: Erwin Emil Stoetzer, Aichach (DE); Werner Josef Harthauser, Wertingen (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 99 days.

(21) Appl. No.: 12/457,343

(22) Filed: Jun. 8, 2009

(65) Prior Publication Data

US 2009/0317194 A1 Dec. 24, 2009

(30) Foreign Application Priority Data

Jun. 13, 2008 (EP) ..... 08010846

(51) Int. Cl.
*E21B 7/00* (2006.01)

(52) U.S. Cl. ..... 173/145; 405/233

(58) Field of Classification Search ..... 405/232, 405/244, 252.1, 253; 173/145, 148, 152, 173/164, 184
See application file for complete search history.

(56) References Cited

U.S. PATENT DOCUMENTS

| | | | | |
|---|---|---|---|---|
| 4,504,173 | A * | 3/1985 | Feklin | 405/240 |
| 5,353,883 | A | 10/1994 | Kattentidt et al. | |
| 5,722,498 | A * | 3/1998 | Van Impe et al. | 175/394 |
| 5,875,860 | A * | 3/1999 | Coelus | 175/323 |
| 6,033,152 | A | 3/2000 | Blum | |
| 6,478,512 | B2 | 11/2002 | Sherwood | |
| 2001/0032741 | A1 * | 10/2001 | Sherwood | 175/162 |
| 2007/0253782 | A1 * | 11/2007 | Stoetzer | 405/241 |

FOREIGN PATENT DOCUMENTS

| | | | |
|---|---|---|---|
| CN | 201162489 | Y | 12/2008 |
| DE | 4220976 | | 7/1993 |
| DE | 60102255 | | 3/2005 |
| EP | 0228138 | A2 | 7/1987 |
| EP | 1041240 | A2 | 10/2000 |
| EP | 1614853 | A2 | 1/2006 |
| GB | 2070668 | | 9/1981 |

* cited by examiner

*Primary Examiner* — Tara Mayo-Pinnock
*Assistant Examiner* — Benjamin Fiorello
(74) *Attorney, Agent, or Firm* — Jacobson Holman PLLC

(57) ABSTRACT

A drilling rig and a drilling method, in which the drilling element is caused to rotate and is displaced along a mast by means of a drilling drive, which drilling element has a continuous screw auger disposed below the drilling drive, and an extension, which is connected to the continuous screw auger and extends upwardly through the drilling drive. A displacement head is disposed between the continuous screw auger and the extension and is adapted to force earth material into the wall of a bore hole.

17 Claims, 2 Drawing Sheets

DRILLING RIG AND DRILLING METHOD

BACKGROUND OF THE INVENTION

1. Field of the Invention

The present invention relates to a drilling rig comprising a mast, a drilling drive mounted for displacement thereon, and a drilling element, which can be rotatably driven and moved along the mast by the drilling drive system, the drilling element comprising a continuous screw auger disposed below the drilling drive system and an extension which is connected to the continuous screw auger and which extends upwardly through the drilling drive.

The invention further relates to a drilling method, in which a drilling element is rotatably driven and moved along a mast by means of a drilling drive, the drilling element comprising a continuous screw auger disposed below the drilling drive and an extension which is connected to the continuous screw auger and which extends upwardly through the drilling drive.

2. Description of Related Art Including Information Disclosed Under 37 CFR §§1.97 and 1.98

The use of so-called continuous screw augers for creating bore holes and, in particular, for creating foundation elements has been known for many years. In a continuous screw auger, a drill helix is disposed along the entire length of the drilling bar for the purpose of conveying loosened earth material out of the bore hole toward the surface by means of rotary motion. A continuous screw auger is driven by means of a drilling drive system, by means of which the continuous screw auger is also moved in the boring direction along a usually vertically positioned mast. In this known method, the depth of the bore hole is restricted by the length of the continuous screw auger and the height of the mast.

In order to increase the depth of the bore hole beyond the length of the mast or the length of the continuous screw auger, DE 601 02 255 T2or EP 1 614 853 B1 proposes that an extension bar be disposed at the top of the continuous screw auger, which extension bar extends upwardly through the drilling drive system. The depth of the bore hole can thus be increased by approximately the length of the extension bar.

However, feed helixes cannot be mounted on the extension bar for functional reasons. When sinking a bore hole beyond the length of the continuous screw auger, the earth material excavated can thus no longer be conveyed by the feed helixes up to the surface. This earth material thus accumulates in the bore hole above the continuous screw auger in the region of the extension bar. This can lead to undesirable earth compaction or choking of the bore hole, which makes it difficult to subsequently withdraw the drilling element from the bore hole. Furthermore, the wall of the bore hole can be damaged in this region, which can adversely affect the installation of a foundation element in the bore hole by filling the same with filling material. In order to prevent this, the drilling element must be intermittently removed from the bore hole to remove the earth material. This is time-consuming.

BRIEF SUMMARY OF THE INVENTION

The object underlying the present invention is to provide a drilling rig and a drilling method, by means of which bore holes can also be efficiently created with the aid of continuous screw augers beyond the length of the latter, whilst ensuring good quality of the bore holes.

This object is achieved according to the invention with a drilling rig having a mast, a drilling drive displaceably mounted thereon and a drilling element which can be rotatably driven and moved along the mast by said drilling drive, which drilling element has a continuous screw auger disposed below the drilling drive and an extension which is connected to said continuous screw auger and extends upwardly through the drilling drive, wherein a displacement head is disposed between said continuous screw auger and said extension; and by a drilling method in which in a first drilling step, the drilling element is rotated and displaced along the mast by means of the drilling drive to sink a bore hole to the first drilling depth, wherein the first drilling depth is approximately equal to the length of said continuous screw auger and at which depth the drilling drive has reached its lower end position at the bottom end of the mast, a material-transporting step is carried out concurrently with the first drilling step, during which earth material is transported by said continuous screw auger from the upper part of the bore hole to the surface, and in a second drilling step starting from said first drilling depth, the drilling element is rotated and displaced along the mast by means of the drilling drive to sink the bore hole to the second drilling depth and earth material is forced into a wall of the upper part of the bore hole by feeding the earth material transported by said feed helix from the lower part of the bore hole to said displacement head.

The drilling rig of the invention is characterized in that a displacement head is disposed between the continuous screw auger and the extension.

When sinking a bore hole beyond the length of the continuous screw auger, the displacement head forces the earth material being conveyed toward the top aside into the wall of the bore hole directly above the continuous screw auger. Thus earth material can no longer accumulate inside the bore hole and therefore lead to choking. Rather, the displacement head forces the earth material aside and in doing so serves to positively compact and additionally stabilize the wall of the bore hole. This improves the stability and quality of the bore hole and actively prevents the bore hole from caving in. In this way, the drilling rig of the invention can be used to sink the bore hole beyond the length of the continuous screw auger in a single continuous operation until the end of the extension has been reached. This considerably accelerates the creation of a bore hole of increased depth and additionally reduces the quantity of excavated material to be hauled away.

In principle, the extension can have any form. In particular, the extension can be a telescope bar or a bar composed of several segments. It is particularly preferred, according to the invention, for the extension bar to be designed as a Kelly bar having drive ridges on its outside surface. The drive ridges on the outsides surface of the normally single-piece bar operatively interact with corresponding entrainers of an output device of the drilling drive system in order to transmit a torque from the drilling drive system to the extension. The drive ridges are disposed parallel to the drilling axis so that the former permit axial displacement of the extension through the annular drilling drive system. So-called locking recesses having transversely directed ridge sections can be further provided for transferring axial forces from the drilling drive system to the extension.

For achieving particularly large drilling depths it is advantageous, according to the invention, when the length of the continuous screw auger is approximately equal to that of the mast or to a maximum movement distance of the drilling drive. The maximum movement distance of the drilling drive, which is displaceable along the mast, can be utilized in this way. A bore hole, the depth of which corresponds to the length of the continuous screw auger, can thus be created efficiently.

For installing a foundation element it is advantageous, according to the invention, when the continuous screw auger and/or the extension comprises a hollow core tube. The hollow core tube thus allows for feeding in a filling material, particularly a solidifying or settable suspension such as concrete, for example, directly through the drilling element after sinking the bore hole. For this purpose, one or more discharge orifices are provided at the bottom end of the continuous screw auger. The bore hole can thus be filled concurrently from the bottom up while withdrawing the continuous screw auger from the bore hole.

A wide variety of displacement heads can be used on the drilling element of the invention. It is thus possible to use, between the extension and the continuous screw auger, axially symmetrical displacement heads, displacement heads that are eccentric relative to the drilling axis or other displacement heads.

It is particularly preferred, according to the invention, when the displacement head comprises a cylindrical displacement section, the diameter of which is approximately equal to the drilling diameter. The drilling diameter is predetermined by the outside diameter of the drill helixes on the continuous screw auger or by corresponding radial cutting edges at the bottom end of the continuous screw auger. The displacement section can be slightly smaller or larger than this drill diameter, depending on the earth properties. An equally dimensioned diameter is advantageous, since it facilitates both the insertion of the displacement head into the bore hole and the withdrawal of the continuous screw auger from the bore hole.

According to the invention, it is advantageous when the displacement head comprises a lower conical section, the diameter of which increases from the diameter of a central tube in the continuous screw auger upwardly to the diameter of the displacement section. Thus, the earth material conveyed up to the displacement head can be gradually forced into the wall of the bore hole. This also facilitates the insertion of the displacement head into the bore hole.

The insertion of the displacement head into the bore hole is further improved, according to the invention, by providing said lower conical section with a lower helix, which can convey earth material upwardly to the displacement section during the drilling operation. This lower helix is thus situated on the conical outside surface of the displacement section and has the same conveying direction as that of the feed helix of the continuous screw auger.

Furthermore, it is advantageous, according to the invention, when the displacement head comprises an upper conical section, the diameter of which tapers from the diameter of the displacement section upwardly to the diameter of the extension. This arrangement allows for material falling onto the displacement head from above to enter the displacement zone of the displacement section.

This effect is assisted, according to the invention, by providing an upper helix, capable of conveying earth material downwardly to the displacement section during the drilling operation, on the upper conical section. This helix thus has a reversed pitch direction compared with the helixes of the continuous screw auger or the helix provided on the lower conical section. The upper helix actively conveys earth material falling from above into the zone of the displacement section.

In a preferred embodiment of the invention, the displacement section and/or at least one of the conical sections thereof is further provided with displacement elements. The displacement elements can be welded-on strips or arcuate segment-shaped elements, which improve the action of forcing or incorporating earth material into the wall of the bore hole. At the same time, the displacement elements can serve as wear parts that can be easily replaced when subjected to heavy-duty earth removal.

The drilling method of the invention is characterized in that in a first drilling step continuing to a first drilling depth equal to the length of the continuous screw auger, earth material is conveyed to the surface by the continuous screw auger, and that in a second drilling step starting from the first drilling depth, the drilled material is fed by the continuous screw auger to the displacement head, by means of which the earth material is forced into the wall of a bore hole.

The advantages described above with respect to the sinking of the bore hole beyond the length of the continuous screw auger, stabilizing the wall of the bore hole and preventing the accumulation of excavated material are achieved when using this method of the invention. This drilling method makes it possible to create the bore hole in a single continuous operation or intermittently in a number of steps, the drilling element being withdrawn at definite time intervals or at certain depths. Particularly effective stabilization of the wall of the bore hole can thus be achieved by virtue of the fact that the displacement head travels past the wall of the bore hole several times.

For creation of a foundation element, it is preferred, according to the invention, that the filling material used to form the foundation element is introduced into the bore hole when the final depth has been reached. The filling material can be a dry material, for example, sand, lime, or the like or a settable suspension such as a concrete mix. The filling material is preferably introduced into the bore hole through a central core tube in the continuous screw auger.

BRIEF DESCRIPTION OF THE SEVERAL VIEWS OF THE DRAWINGS

The invention is further explained below with reference to preferred exemplary embodiments illustrated diagrammatically in the attached drawings, in which.

DETAILED DESCRIPTION OF THE INVENTION

Figure 1:
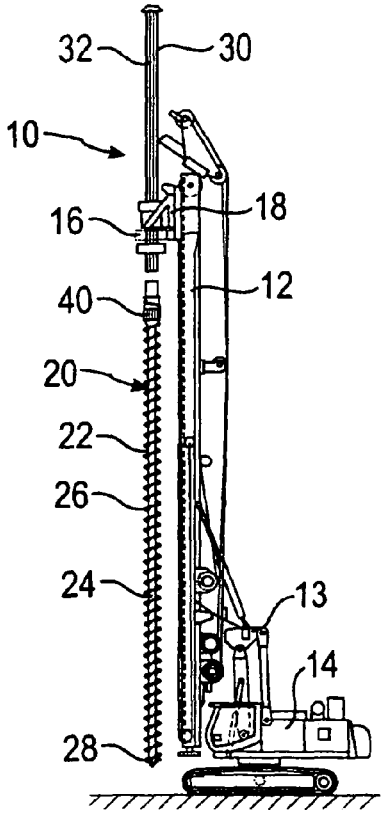
FIG. 1 is a diagrammatic side view of a drilling rig of the invention at the commencement of the drilling method of the invention.
Figure 2:
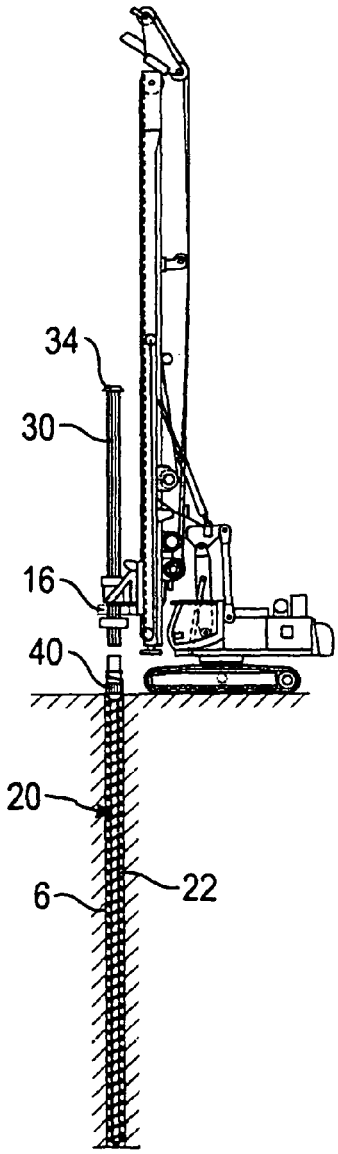
FIG. 2 is a diagrammatic side view of the drilling rig shown in FIG. 1 on conclusion of the first drilling step.
Figure 3:
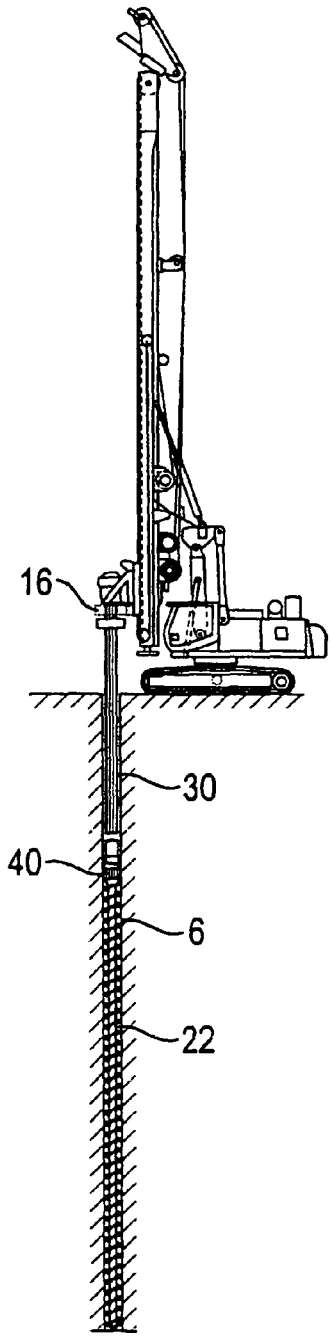
FIG. 3 is a diagrammatic lateral view of the rig shown in FIG. 1 and FIG. 2 in the second drilling step.

A drilling method of the invention together with a drilling rig 10 of the invention is illustrated in FIGS. 1 to 3. As shown in FIG. 1, the drilling rig 10 comprises an approximately vertically aligned mast 12, which is pivotally mounted via an adjusting mechanism 13 on a base 14. The base 14 is in the present exemplary embodiment in the form of a crawler type vehicle having a rotatable superstructure.

A slide 18 is mounted in known manner for displacement along the mast 12 via a cable pulley mechanism. An annular drilling drive 16 is provided on the slide 18 for the purpose of driving the bar-shaped drilling element 20. The lower region of the drilling element 20 comprises a so-called continuous screw auger 22, which is composed of a mid-conduit or core tube 24, on the outside surface of which a feed helix 26 extends over virtually the entire length thereof. A cutting unit 28 for removing the earth material is formed in known manner on the bottom end of the continuous screw auger 22.

The length of the continuous screw auger 22 is adjusted to that of the mast 12 and is approximately equal to the length of the mast 12. In the exemplary embodiment illustrated, the mast has a length of about 20 m, while the length of the continuous screw auger is about 15 m. The length of the continuous screw auger 22 is somewhat shorter than the length of the mast 12, this being substantially due to the size and length of the drilling drive 16, including the slide 18.

Figure 5:
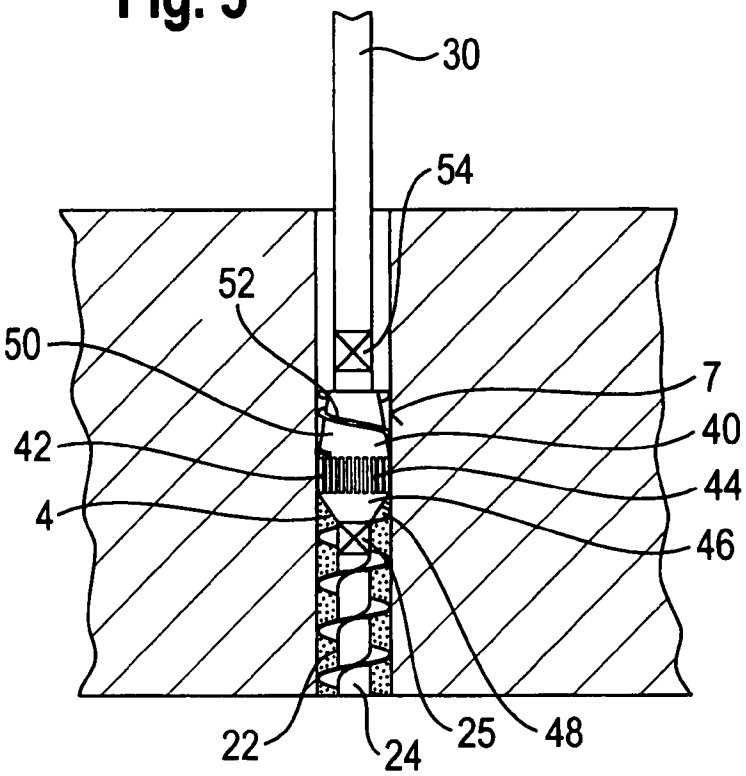
FIG. 5 is a diagrammatic partial view of the drilling rig of the invention during the second drilling step.
Figure 4:
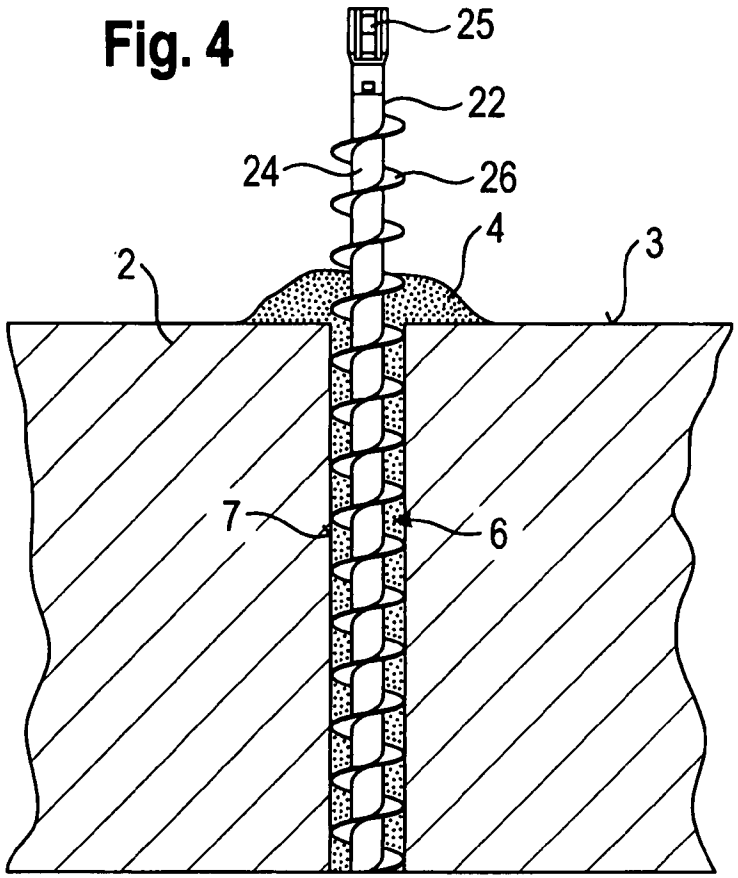
FIG. 4 is a diagrammatic partial view of the drilling rig of the invention during the first drilling step.

A displacement head 40, which will be described below in more detail with reference to FIGS. 4 and 5, is connected to the top end of the continuous screw auger 22 below the drilling drive 16. Adjoining the displacement head 40, a bar-shaped extension 30 is attached, which extends upwardly through the annular drilling drive 16 from the displacement head 40 disposed below the drilling drive system 16. Drive ridges 32 extending longitudinally in the drilling direction are disposed on the outside surface of the extension 30 as in a Kelly bar. The torque of the drilling drive system 16 can be transmitted by way of these drive ridges 32 to the extension 30 and thus to the drilling element 20 as a whole. The drive ridges 32 further permit, in known manner, axial displacement of the extension 30 in relation to the drilling drive 16 with concurrent torque transmission.

In a first drilling step illustrated in FIG. 2, a bore hole 6 is sunk until the top end of the continuous screw auger 22 is reached. During this first drilling step, earth material removed by the cutting unit 28 is conveyed by the feed helixes 26 upwardly out of the bore hole 6. On conclusion of the first drilling step, the drilling drive 16 is moved until it reaches its maximum movement distance, that is to say, from its upper initial position shown in FIG. 1 to its lower end position at the bottom end of the mast. In order to sink the bore hole 6 further, the drilling element 20 is moved further down by way of the extension 30 with the drilling drive 16 now stationary. The downward advance of the drilling rig in the drilling direction can significantly be brought about substantially by the weight of the drilling element 20 and the propelling action of the feed helixes 26. However, the drilling drive 16 can alternatively be reset and the extension 30 can be actively moved in the drilling direction.

In this second drilling step, the removed earth material can no longer be conveyed by the feed helixes 26 of the continuous screw auger 22 toward the surface. In order to prevent choking in the region of the bar-shaped extension 30, which has now entered the bore hole 6, the displacement head 40 forces this removed earth material, aside into the wall of the bore hole as proposed by the invention. On conclusion of the second drilling step, in which the bar-shaped extension is moved into its bottom end position as shown in FIG. 3, filling material can be fed into the bore hole 6 at the bottom end of the continuous screw auger 22 from a suspension port 34 at the top end of the extension 30 via the inner cavity of the extension 30 and the core tube 24.

FIG. 4 illustrates the drilling method of the invention during the first drilling step. Here, a bore hole 6 is formed in the ground 2 by the continuous screw auger 22. Feed helixes 26 convey the removed earth material 4 upwardly out of the bore hole 6 toward a surface 3. The excavated earth material 4 can be removed from here and hauled away in known manner.

At the top end of the core tube 24 of the continuous screw auger 22 there is disposed a tube connection 25, to which the displacement head 40 (not illustrated here) is coupled non-rotatably.

On conclusion of the first drilling step, when the maximum movement distance of the drilling drive 16 has been reached and the continuous screw auger 22 penetrates the ground 2 over its entire length, the displacement head 40 forces the earth material 4 being conveyed upwardly aside into the wall of the bore hole 7, as shown in FIG. 5.

In the preferred exemplary embodiment, the displacement head 40 comprises an approximately central, cylindrical displacement section 42, on the outside surface of which strip-shaped displacement elements 44 are disposed. A lower conical section 46, the outside surface of which is provided with a lower helix 48, is disposed below the displacement section 42. The lower helix 48 serves to convey the removed earth material 4 into the region of the displacement section 42.

The inverted cone-shaped lower conical section 46 is non-rotatably connected to the continuous screw auger 22 with the aid of the conduit connection 25. The diameter of the lower conical section 46 continuously increases from the diameter of the core tube 24 to the diameter of the cylindrical displacement section 42.

Conversely, an upper conical section 50 comprising an upper helix 52 is disposed above the displacement section 42. The upper helix 52 has a counter-conveying direction in relation to that of the lower helix 48 so that earth material is conveyed by the upper helix 52 downwardly to the central displacement section 42 in the usual drilling direction.

The upper conical section 50 is of a regular conical shape, the diameter of which uniformly tapers from the diameter of the displacement section 42 upwardly to approximately the diameter of the bar-shaped extension 30. The bar-shaped extension 30 is connected non-rotatably to the displacement head 40 via an upper tube connection 54.

The invention claimed is:

1. A drilling rig, comprising a mast having top and bottom ends, a drilling drive displaceably mounted on the mast for movement over a maximum movement distance between an upper initial position and a lower end position at the bottom end of the mast, the drilling drive being displaceable during a first drilling step to a first drilling depth at which the drilling drive has reached its lower end position, a drilling element which is rotatably drivable and movable along the mast by said drilling drive, wherein the drilling element has:

a continuous screw auger disposed below the drilling drive for creating a bore hole having an upper part in the first drilling step and a lower part in a second drilling step following the first drilling step, wherein the upper part extends below a surface to the first drilling depth and the lower part extends below the first drilling depth to a second drilling depth, the continuous screw auger having a cutting unit on its bottom end for removing earth material from the bore hole, and a feed helix extending over substantially the entire length of the continuous screw auger for conveying earth material removed from the upper part of the bore hole by the cutting unit toward the surface by rotary motion during the first drilling step and for conveying earth material removed from the lower part of the bore hole by the cutting unit toward the upper part during the second drilling step, wherein the continuous screw auger has a length that is one of approximately equal to one of the length of the mast and the maximum movement distance of the drilling drive, an extension which is connected to said continuous screw auger and extends upwardly through the drilling drive, the extension being longitudinally displaceable in the drilling drive in a downward direction during the second drilling step, drive pins disposed on an outside surface of the extension for transmitting torque of the drilling drive, and a displacement head disposed between said continuous screw auger and said extension, for forcing the earth material being conveyed by the feed helix from the lower part of the bore hole toward the upper part aside into the wall of the upper part of the bore hole directly above the continuous screw auger during the second drilling step, wherein the displacement head has a cylindrical displacement section having an outside surface having displacement elements disposed thereon, the diameter of said displacement section being approximately equal to the drill diameter.

2. The drilling rig as defined in claim 1, wherein the extension is configured as a telescopic bar, and the drive pins are on the outside thereof.

3. The drilling rig as defined in claim 1, wherein at least one of the continuous screw auger and the extension has a hollow core tube.

4. The drilling rig as defined in claim 1, wherein said continuous screw auger has a central tube, and the displacement head has a lower conical section, the diameter of which increases from that of the central tube of said continuous screw auger upwardly to the diameter of said displacement section.

5. The drilling rig as defined in claim 4, further comprising:

a lower helix disposed at the lower conical section between the feed helix and the displacement section, the lower helix having the same conveying direction as that of the feed helix of the continuous screw auger for transporting earth material upwardly to the displacement section during the drilling operation.

6. The drilling rig as defined in claim 1, wherein the displacement head has an upper conical section, the diameter of which decreases from that of said displacement section upwardly toward said extension.

7. The drilling rig as defined in claim 6, wherein an upper helix is disposed at said upper conical section, which helix causes earth material to be transported downwardly to the displacement section during the drilling operation.

8. The drilling rig as defined in claim 1, wherein said displacement section and/or at least one of said conical sections are provided with displacement elements.

9. The drilling rig as defined in claim 1, wherein the displacement head is interchangeable.

10. The drilling rig as defined in claim 1, wherein the displacement head is disconnectable from said continuous screw auger.

11. The drilling method as defined in claim 1, wherein in the first drilling step, the drilling element is movable downward by way of the drilling drive, and during the second drilling step, the drilling element is movable downward by way of the extension.

12. A drilling method implemented using the drilling rig as defined in claim 1, comprising:

a first drilling step in which the drilling element is rotated and displaced along the mast by means of the drilling drive to sink a bore hole to the first drilling depth, wherein the first drilling depth is approximately equal to the length of said continuous screw auger and at which depth the drilling drive has reached its lower end position at the bottom end of the mast, a material-transporting step carried out concurrently with the first drilling step, during which earth material is transported by said continuous screw auger from the upper part of the bore hole to the surface, and a second drilling step starting from said first drilling depth, of rotating and displacing the drilling element along the mast by means of the drilling drive to sink the bore hole to the second drilling depth and of forcing earth material into a wall of the upper part of the bore hole by feeding the earth material transported by said feed helix from the lower part of the bore hole to said displacement head.

13. The drilling method as defined in claim 12, wherein the drilling drive is held stationary on the mast in the second drilling step.

14. A method for the production of a foundation element, comprising:

producing a bore hole by the drilling method as defined in claim 12 and when the final drilling depth has been achieved, placing filling material in the bore hole to form the foundation element.

15. A drilling rig, comprising a mast having top and bottom ends, a drilling drive displaceably mounted on the mast for movement over a maximum movement distance between an upper initial position and a lower end position at the bottom end of the mast, a drilling element which is rotatably drivable and movable along the mast by said drilling drive, wherein the drilling element has:

a continuous screw auger disposed below the drilling drive for creating a bore hole having an upper part and a lower part, wherein the upper part extends below a surface to a first drilling depth and the lower part extends below the first drilling depth to a second drilling depth, the continuous screw auger having a cutting unit on its bottom end for removing earth material from the bore hole, and a feed helix extending over substantially the entire length of the continuous screw auger for conveying earth material removed from the upper part of the bore hole by the cutting unit toward the surface by rotary motion during the first drilling step and for conveying earth material removed from the lower part of the bore hole by the cutting unit toward the upper part during the second drilling step, an extension which is connected to said continuous screw auger and extends upwardly through the drilling drive, the extension having torque transmitted thereto from the drilling drive, and a displacement head disposed between said continuous screw auger and said extension, for forcing the earth material being conveyed by the feed helix from the lower part of the bore hole toward the upper part aside into the wall of the upper part of the bore hole directly above the continuous screw auger during the second drilling step, the displacement head having a cylindrical displacement section having an outside surface having displacement elements disposed thereon, the diameter of said displacement section being approximately equal to the drill diameter.

16. The drilling rig as defined in claim 15, wherein the displacement elements comprise one of welded-on strips and arcuate segment-shaped elements, which improve the action of forcing earth material into the wall of the upper part of the bore hole.

17. A drilling method implemented using the drilling rig as defined in claim 15, comprising:

a first drilling step in which the drilling element is rotated and displaced along the mast by means of the drilling drive to sink a bore hole to the first drilling depth, wherein the first drilling depth is approximately equal to the length of said continuous screw auger and at which depth the drilling drive has reached its lower end position at the bottom end of the mast, a material-transporting step carried out concurrently with the first drilling step, during which earth material is transported by said continuous screw auger from the upper part of the bore hole to the surface, and a second drilling step starting from said first drilling depth, of rotating and displacing the drilling element along the mast by means of the drilling drive to sink the bore hole to the second drilling depth and of forcing earth material into a wall of the upper part of the bore hole by feeding the earth material transported by said feed helix from the lower part of the bore hole to said displacement head.

* * * * *